US006376167B1

(12) United States Patent
Ito

(10) Patent No.: US 6,376,167 B1
(45) Date of Patent: Apr. 23, 2002

(54) PHOTOTHERMOGRAPHIC MATERIAL

(75) Inventor: Hiroto Ito, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/708,097

(22) Filed: Nov. 6, 2000

(30) Foreign Application Priority Data

Nov. 9, 1999 (JP) ..... 11-318263

(51) Int. Cl.[7] ..... G03C 1/498; G03C 1/34

(52) U.S. Cl. ..... 430/619; 430/607; 430/611; 430/613

(58) Field of Search ..... 430/619, 611, 430/613, 607

(56) References Cited

U.S. PATENT DOCUMENTS 6,165,707 A * 12/2000 Hirano et al. ..... 430/619

6,274,302 B1 * 8/2001 Watanabe et al. ..... 430/619

* cited by examiner

*Primary Examiner*—Thorl Chea

(74) *Attorney, Agent, or Firm*—Bierman, Muserlian and Lucas

(57) ABSTRACT

A photothermographic material is disclosed, comprising on a support an organic silver salt, a photosensitive silver halide, a reducing agent, a binder and a compound represented by the following formula $$R_1—SO_2—O—L_1—COOM_1.$$

The photothermographic material may further comprise a compound respresented by following formula:

$$R_2—COOM_2 \text{ or } R_3—CO—L_2—COOM_3.$$

22 Claims, No Drawings

PHOTOTHERMOGRAPHIC MATERIAL

FIELD OF THE INVENTION

Present invention relates to photothermographic materials and a image recording method and image forming process by the use thereof.

BACKGROUND OF THE INVENTION

In the field of graphic arts and medical diagnosis, waste liquor produced in wet-processing of image forming material results in problems and further reduction of processing effluent is strongly desired in terms of environmental protection and space saving. Accordingly, a technique for photothermographic materials is required which enables efficient exposure by means of a laser image setter or a laser imager and formation of black images exhibiting high resolution and clearness.

As such a technique is known a thermally developable photothermographic material which comprises on a support an organic silver salt, light sensitive silver halide grains, reducing agent and a binder, as described in U.S. Pat. Nos. 3,152,904 and 3,487,075, and D. H. Klosterboer "Thermally Processed Silver Systems" (Imaging Processes and Materials) Neblette, 8th Edition, edited by Sturge, V. Walworth, and A. Shepp, page 279, 1989), etc.

The photothermographic material comprises a reducible silver source (e.g., an organic silver salt), a catalytically active amount of photo-catalyst (e.g., silver halide) and a reducing agent, which are contained in the form of a dispersion in an organic binder matrix. The photothermographic material is stable at ordinary temperature and forms silver through an oxidation-reduction reaction between a reducible silver source (functioning as an oxidant) and a reducing agent when exposed and heated at a high temperature (e.g., 80° C. or higher).

The oxidation-reduction reaction is promoted by catalytic action of the latent image produced by exposure to light. Silver formed from the reaction of the organic silver salt in the exposed area provides a black image which is contrasted with the unexposed area, leading to image information. There are employed antifoggants to restrain fogging accompanied with image formation and the most effective method of conventional technologies for restraining fogging is the use of a mercury compound as an antifoggant.

Incorporation of a mercury compound as an antifoggant into a photothermographic material is described, for example, in U.S. Pat. No. 3,589,903. However, the use of highly toxic mercury compounds is not desirable and development of a non-mercury type antifoggant has been desired. Various kinds of polyhalogen compounds are described as a non-mercury type antifoggant, in U.S. Pat. Nos. 3,874,946, 4,756,000 and 5,340,712; European patent Nos. 605,981A1, 622,666A1 and 631,176A1; JP-B No. 54-165 (hereinafter, the term, JP-B refers to a published Japanese Patent) and JP-A No. 7-2781 (hereinafter, the term, JP-A refers to an examined and published Japanese Patent Application).

However, these compounds resulted in problems that an antifogging effect was relatively low or silver image tone was deteriorated. There was also a problem that when a photothermographic material was exposed and processed after being forced to age under the conditions of high temperature and high humidity, fogging in unexposed areas markedly increased.

JP-A Nos. 9-160164, 9-244178, 9-258367, 9-265150, 9-281640 and 9-319022 describe poly-halogenated compounds to improve these problems. However, when these polyhalogen compounds were applied to a photothermographic material used in the laser imager for medical use or photothetmographic materials containing a contrast-increasing agent and used for an output of the laser image setter for graphic arts use and having an oscillation wavelength of 600 to 800 nm, the above-described problems were overcome but there were still problems in aging stability such that processed photothermographic materials increased a fog density with aging.

JP-A No. 6-208193 discloses a photothermographic material in which a halogenated antifoggant and a isocyanate group-containing compound are incorporated to improve storage stability in fogging. However, this technique had still problems that aging stability of images was not sufficient and this type of an antifogging compound reacted with the elapse of time at the stage of preparing a coating solution in the manufacturing process, resulting in marked variation in sensitivity of the photothermographic material.

JP-A Nos. 64-72145 and 9-281637 disclose a photothermographic material, in which a benzoylcarboxylic acid type antifoggant is incorporated to improve storage stability in fogging. However, there is still a problem that deteriorated performance such as variation in sensitivity was caused after aging storage.

In view of the foregoing, there has been desired a photothermographic material improved in the problems described above and specifically exhibiting superior storage stability in fogging.

SUMMARY OF THE INVENTION

Accordingly, it is an object of the present invention to provide a photothermographic material exhibiting low fogging, high sensitivity and superior storage stability, and an image recording method and an image forming process by the use of the same.

The above object of the invention can be accomplished by the following constitution:

1. A photothermographic material comprising on a support an organic silver salt, a photosensitive silver halide, a reducing agent, a binder and a compound represented by the following formula (1):

$$R_1—SO_2—O—L_1—COOM_1 \qquad \text{formula (1)}$$

where in $R_1$ represents a hydroxy group, a mercapto group, a halogen atom, a cyano group, a sulfo group, a nitro group, a sulfino group, a hydrazino group, a heterocyclic group, a hydrocarbon group or a group formed by the combination of these groups; $M_1$ represents a cation; and $L_1$ represents a bivalent group;

2. The photothermographic material described in 1, wherein the photothermographic material further comprises a compound represented by the following formula (2):

$$R_2—COOM_2 \qquad \text{formula (2)}$$

wherein $R_2$ represents a hydroxy group, a mercapto group, a halogen atom, a cyano group, a sulfo group, a nitro group, a sulfino group, a hydrazino group, a heterocyclic group, a hydrocarbon group or a group formed by the combination of these groups; $M_2$ represents a cation;

3. The photothermographic material described in 1, wherein the photothermographic material further comprises a compound represented by the following formula (3):

$$R_3—CO—L_2—COOM_3 \qquad \text{formula (3)}$$

wherein $R_3$ represents a hydroxy group, a mercapto group, a halogen atom, a cyano group, a sulfo group, a nitro group, a sulfino group, a hydrazino group, a heterocyclic group, a hydrocarbon group or a group formed by the combination of these groups; $M_3$ represents a cation and $L_2$ represents a bivalent group.

4. An image recording method, wherein a photothermographic material described in any one of 1 through 3 above is exposed by using a laser exposure apparatus, in which scanning laser light is not exposed at an angle substantially vertical to the exposed surface of the photosensitive material;
5. An image recording method, wherein a photothermographic material described in any one of 1 through 3 above is exposed by using a laser exposure apparatus, in which scanning laser light is longitudinally multiple;
6. An image forming method, wherein a photothermographic material described in any one of 1 through 3 above is thermally developed in a state of containing a solvent of 1 to 1000 mg/cm$^2$.

DETAILED DESCRIPTION OF THE INVENTION

The present invention will be further described in detail. In photothermographic materials according to this invention, it was found that the use of the compound represented by formula (1) and containing a sulfonyloxy group and a carboxy group and/or its salt led to markedly enhanced storage stability with respect to fogging, as compared to benzoylcarboxylic acid type antifoggant conventionally used in photothermographic materials it was further proved that the storage stability in fogging was further enhanced by the use of the compound of formula (1) in combination with the compound represented by formula (2) or (3). It was also found that the use of the compound of formula (1), (2) or (3) also led to enhanced light fastness of the formed images.

The compounds represented by formulas (1), (2) and (3) will be explained.

In formulas (1), (2) and (3), $R_1$, $R_2$ and $R_3$ each represent a hydroxy group, a mercapto group, a halogen atom, a cyano group, a sulfo group, a nitro group, a sulfino group, a hydrazine group, a heterocyclic group, a hydrocarbon group or a group formed by the combination of these groups.

The halogen atoms represented by $R_1$, $R_2$ and $R_3$ include a fluorine atom, a chlorine atom, and a bromine atom.

The hydrazino group represented by $R_1$, $R_2$ and $R_3$ is an alkylhydrazino group and arylhydrazino group. The alkyl group of the alkylhydrazino group include, for example, methyl, ethyl, propyl, butyl, octyl and decyl. The aryl group of the arylhydrazino group include, for example, phenyl and naphthyl. The groups may be substituted.

The heterocyclic group represented by $R_1$, $R_2$ and $R_3$ is preferably a 5-, 6- or 7-membered ring, which may further be condensed, and examples thereof include an imidazolyl group, pyridyl group, furyl group, piperidyl group and morpholine group. The hydrocarbon group represented by $R_1$, $R_2$ and $R_3$ is a straight chain, branched or cyclic alkyl group (preferably having 1 to 30 carbon atoms, more preferably 1 to 20 carbon atoms, still more preferably 1 to 16 carbon atoms, and including, e.g., methyl, ethyl, iso-propyl, tert-butyl, n-octyl, n-decyl, n-hexadecyl, cyclopropyl, cyclopentyl, cyclohexyl and 2-ethylhexyl), an alkenyl group (preferably having 2 to 30 carbon atoms, more preferably 2 to 20 carbon atoms, still more preferably 2 to 16 carbon atoms, and including, e.g., vinyl, allyl, 2-butenyl, and 3-pentenyl), an alkynyl group (preferably having 2 to 30 carbon atoms, more preferably 2 to 20 carbon atoms, still more preferably 2 to 16 carbon atoms, and including, e.g., ethynyl, 1-propynyl, and 3-pentynyl), an aryl group (preferably having 6 to 30 carbon atoms, more preferably 6 to 20 carbon atoms, still more preferably 6 to 16 carbon atoms, and including, e.g., phenyl, naphthyl, anthonyl, phenanthonyl, and pyrenyl), and an aralkyl group (preferably having 7 to 30 carbon atoms, more preferably 7 to 20 carbon atoms, still more preferably 7 to 16 carbon atoms, and including, e.g., benzyl, phenethyl, diphenylmethyl, and tolytyl). The hydrocarbon group may be substituted by a substituent group, such as a hydroxy group, mercapto group, halogen atom (e.g., fluorine atom, chlorinre atom, bromine atom, iodine atom), cyano group, sulfo group, nitro group, sulfino group, hydrazine group, heterocyclic group (e.g., imidazolyl group, pyridyl group, furyl group, piperidino group, morpholino group, etc.). Of these groups represented by $R_1$, $R_2$ and $R_3$, a hydrocarbon group is preferred, and an alkyl group, aryl group and aralkyl group are more preferred, and an alkyl group and aryl group are still more preferred, and a halogen-substituted alky or aryl group is most preferred.

A bivalent hydrocarbon group represented by $L_1$ or $L_2$ include, for example, a straight chain, branched or cyclic alkylene group (preferably having 1 to 10 carbon atom, more preferably 1 to 6 carbon atoms and still more preferably 1 to 3 carbon atom, including, e.g., methyl, ethylene, trimethylene, propylene, ethylethylene, hexamethylene, 1,2-cyclohexylene, etc.), an alkenylene group (preferably having 2 to 10 carbon atom, more preferably 2 to 6 carbon atoms and still more preferably 2 to 4 carbon atom, including, e.g., vinylene, propenylene, etc.), an alkynylene group (preferably having 2 to 10 carbon atom, more preferably 2 to 6 carbon atoms and still more preferably 2 to 4 carbon atom, including, e.g., ethynylene, 3-pentynylene, etc.), an arylene group (preferably having 6 to 20 carbon atom, more preferably 6 to 16 carbon atoms and still more preferably 6 to 12 carbon atom, including, e.g., phenylene, naphthylene, etc.), an aralkylene group (preferably having 7 to 20 carbon atom, more preferably 7 to 16 carbon atoms and still more preferably 7 to 12 carbon atom, including, e.g., xylylene, etc.). Of the bivalent hydrocarbon groups represented by $L_1$ or $L_2$ an alkylene group or an arylenes group is preferred, and an alkylene group or phenylene group is, more preferred. Concretely, methylene, ethylene, propylene and phenylene groups are preferred, and a phenylene group is more preferred, and a o-phenylene group is still more preferred.

The bivalent hydrocarbon group represented by $L_1$ or $L_2$ may be substituted. Examples of the substituent include an alkyl group (preferably having 1 to 20 carbon atoms, more preferably 1 to 12 carbon atoms, still more preferably 1 to 8 carbon atoms, and including, e.g., methyl, ethyl, iso-propyl, tert-butyl, n-octyl, n-decyl, n-hexadecyl, cyclopropyl, cyclopentyl and cyclohexyl), an alkenyl group (preferably having 2 to 20 carbon atoms, more preferably 2 to 12 carbon atoms, still more preferably 2 to 8 carbon atoms, and including, e.g., vinyl, allyl, 2-butenyl, and 3-pentenyl), an alkynyl group (preferably having 2 to 30 carbon atoms, more preferably 2 to 20 carbon atoms, still more preferably 2 to 12 carbon atoms, and including, e.g., ethynyl, 1-prpynyl, and 3-pentynyl), an aryl group (preferably having 6 to 30 carbon atoms, more preferably 6 to 20 carbon atoms, still more preferably 6 to 16 carbon atoms, and including, including e.g., naphthyl), an amino group (preferably having 0 to 20 carbon atoms, more preferably 0 to 10 carbon atoms, and still more preferably 0 to 6 carbon atoms, including, e.g., amino, methylamino, dimethylamino, diethylamino, and dibenzylamino), an alkoxy group (preferably having 1 to 20 carbon atoms, more preferably 1 to 12 carbon atoms, and still more preferably 1 to 8 carbon atoms, e.g., including methoxy, ethoxy and butoxy), an aryloxy group (preferably having 6 to 20 carbon atoms, more preferably 6 to 16 carbon atoms, and still more preferably 6 to 12 carbon atoms, including, e.g., phenyloxy and 2-naphthyloxy), an acyl group (preferably having 1 to 20 carbon atoms, more preferably 1 to 16 carbon atoms, and still more preferably 1 to 12 carbon atoms, e.g., acetyl, benzoyl, formyl, and pivaloyl), an alkoxycarbonyl (preferably having 2 to 20 carbon atoms, more preferably 2 to 16 carbon atoms, and still more preferably 2 to 12 carbon atoms, including e.g., methoxycarbonyl and ethoxycarbonyl), an aryloxycarbonyl group (preferably having 7 to 20 carbon atoms, more preferably 7 to 16 carbon atoms, and still more preferably 7 to 10 carbon atoms, including e.g., phenyoxycarbonyl), an alkylsulfonylamino group (preferably having 1 to 20 carbon atoms, more preferably 1 to 16 carbon atoms, and still more preferably 1 to 12 carbon atoms, including e.g., methansulfonylamino and benzenesulfonylamino), a sulfamoyl group (preferably having 0 to 20 carbon atoms, more preferably 0 to 16 carbon atoms, and still more preferably 0 to 12 carbon atoms, including e.g., sulfamoyl and methylsulfamoyl), a carbamoyl group (preferably having 1 to 20 carbon atoms, more preferably 1 to 16 carbon atoms, and still more preferably 1 to 12 carbon atoms, including e.g., carbamoyl, methylcarbamoyl, and phenylcarbamoyl), an alkylthio group (preferably having 1 to 20 carbon atoms, more preferably 1 to 16 carbon atoms, and still more preferably 1 to 12 carbon atoms, including e.g., methylthio and ethylthio), an arylthio group (preferably having 6 to 20 carbon atoms, more preferably 6 to 16 carbon atoms, and still more preferably 6 to 12 carbon atoms, including e.g., phenylthio), a sulfonyl group (preferably having 1 to 20 carbon atoms, more preferably 1 to 16 carbon atoms, and still more preferably 1 to 12 carbon atoms, including e.g., mesyl and tosyl), a sulfinyl group (preferably having 1 to 20 carbon atoms, more preferably 1 to 16 carbon atoms, and still more preferably 1 to 12 carbon atoms, including e.g., methanesulfonyl and benzenesulfonyl), hydroxy group, mercapto group, a halogen atom (e.g., fluorine atom, chlorine atom, bromine atom and iodine atom), cyano group, nitro group, sulfino group, hydrazine group, and a heterocyclic group (e.g., imidazolyl, pyridyl, furyl, piperidyl, and morpholine). These substituent groups may be further substituted. In cases where substituent groups are two or more, they may be the same of different from each other.

Of these substituent group, an alkyl group, an aryl group, an alkoxy group, an aryloxy group, an alkylthio group, an arylthio group, an acyl group, an alkoxycarbonyl group, an aryloxycarbonyl group, an acyloxy group, an acylamino group, an alkoxycarbonylamino group, a sulfonylamino group, sulfamoyl group, a carbamoyl group, hydroxy group, a halogen atom, cyano group, and a heterocyclic group are preferred; and an alkyl group and a halogen atom are more preferred, and an alkyl group is still more preferred. R (i.e., $R_1$, $R_2$ and $R_3$) and L (i.e., $L_1$ and $L_2$) may combine together with each other to form a ring.

The cation represented by M represents a hydrogen atom, or organic or inorganic cations, including an alkali metal ion (e.g., lithium ion, sodium ion, potassium ion, and cesium ion), alkaline earth metal ion (e.g., magnesium ion, and calcium ion), an ammonium (e.g., ammonium, trimethylammonium, triethylammonium, tetramethylammonium, tetraetylammonium, and tetrabutylammonium), pyridynium, imidazolium, and phosphonium. Of these, M is preferably a hydrogen atom or an alkali metal ion, and more preferably a hydrogen atom.

Exemplary examples of the compounds respresented by formula (1) are shown below, but are by no means limited to these.

(1)-1

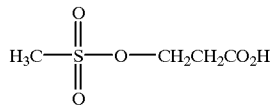

(1)-2

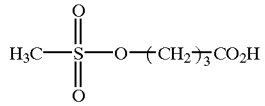

(1)-3

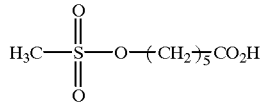

(1)-4

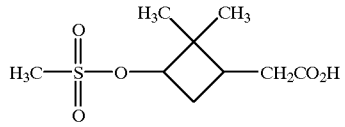

(1)-5

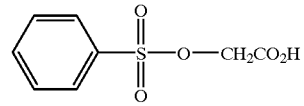

(1)-6

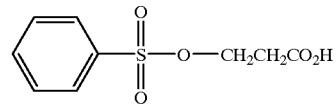

(1)-7

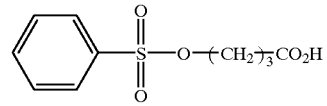

(1)-8

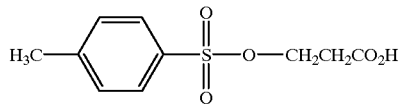

(1)-9

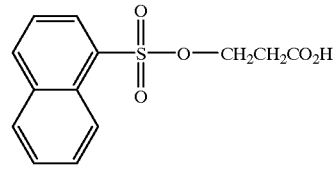

(1)-10

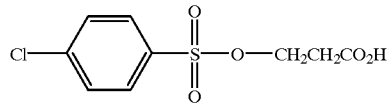

-continued
(1)-11
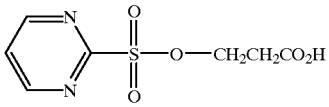
(1)-12
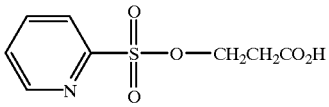
(1)-13
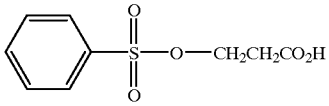
(1)-14
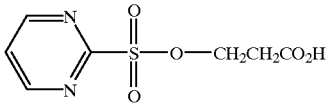
(1)-15
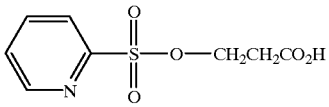
(1)-16
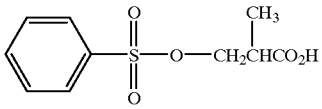
(1)-17
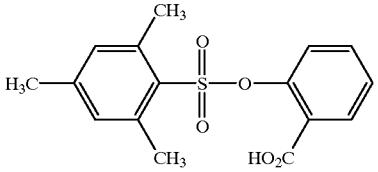
(1)-18
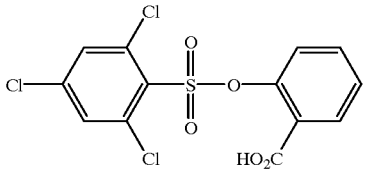
(1)-19
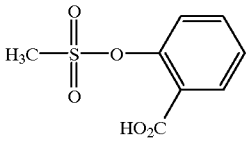
(1)-20
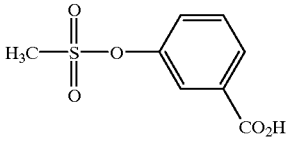
(1)-21
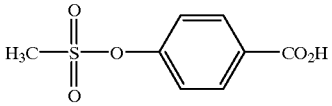
-continued
(1)-22
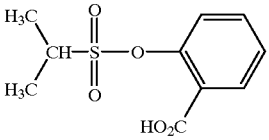
(1)-23
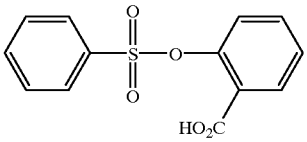
(1)-24
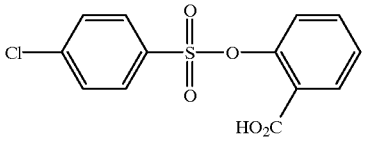
(1)-25
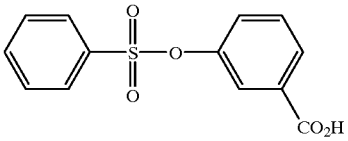
(1)-26
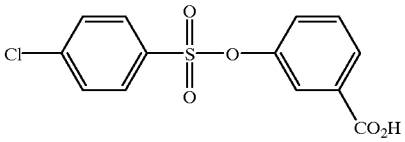
(1)-27
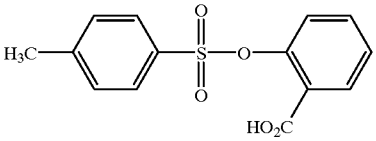
(1)-28
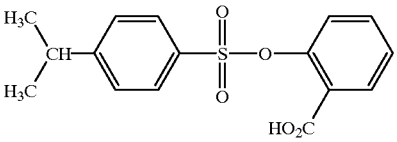
(1)-29
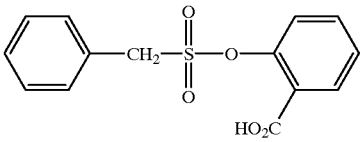
(1)-30
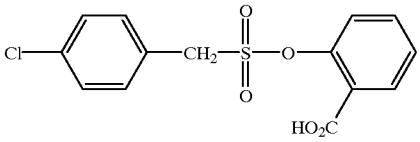

-continued
(1)-31
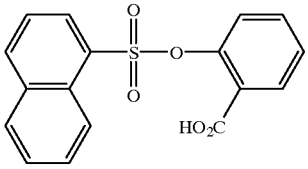
(1)-32
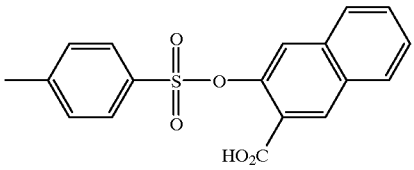
(1)-33
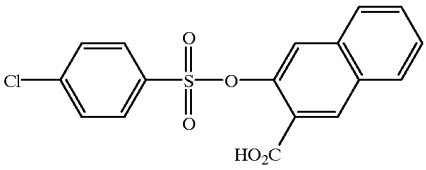
(1)-34
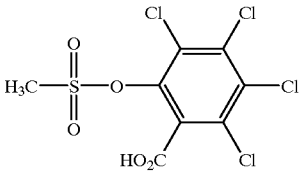
(1)-35
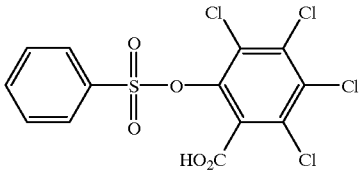
(1)-36
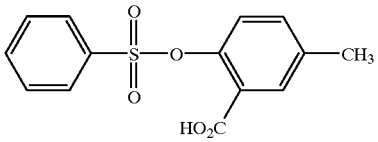
(1)-37
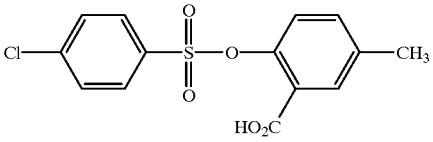
(1)-38
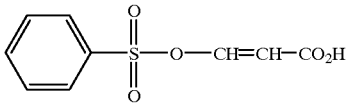
(1)-39
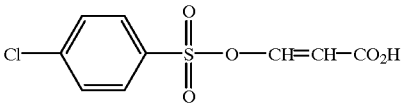
-continued
(1)-40
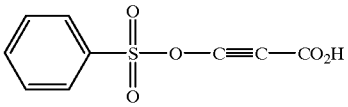
(1)-41
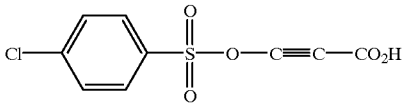
Exemplary examples of the compounds respresented by formula (2) are shown below, but are by no means limited to these.
(2)-1
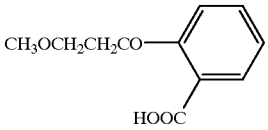
(2)-2
$CH_3OCH_2CH_2OCH_2CH_2COCH_2CH_2COOH$
(2)-3
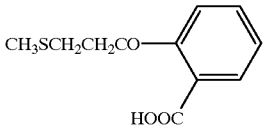
(2)-4
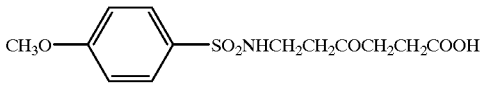
(2)-5
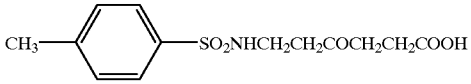
(2)-6
$CH_3CH_2CONHCH_2CH_2COCH_2CH_2COOH$
(2)-7
$HOOC(CH_2)_{12}COOH$
(2)-8
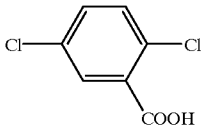
(2)-9
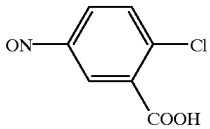
(2)-10
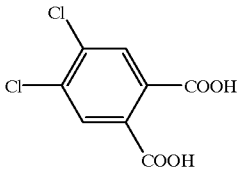

-continued
(2)-11
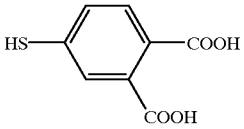
(2)-12
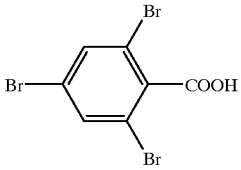
(2)-13
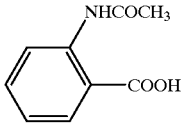
(2)-14
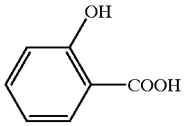
(2)-15
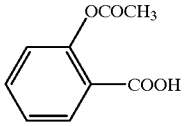
(2)-16
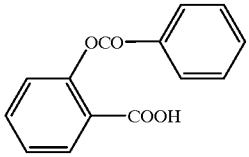
(2)-17
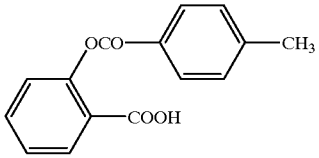
(2)-18
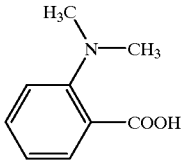
(2)-19
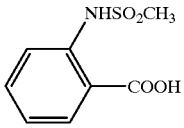
-continued
(2)-20
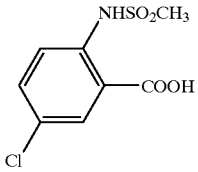
(2)-21
$HOOC(CH_2)_8COOH$
(2)-22
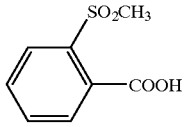
(2)-23
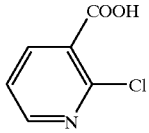
(2)-24
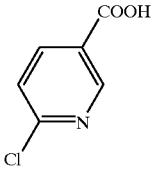
(2)-25
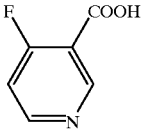
(2)-26
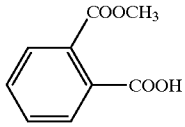
(2)-27
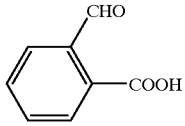
(2)-28
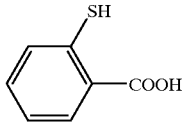
(2)-29
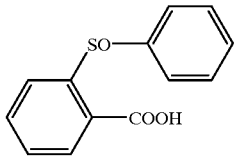

-continued
(2)-30
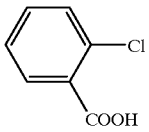
(2)-31
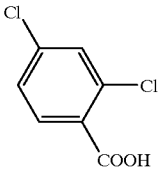
(2)-32
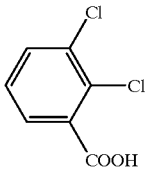
(2)-33
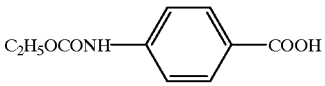
(2)-34
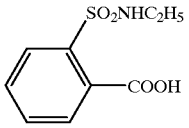
(2)-35
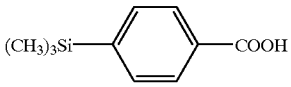
(2)-36
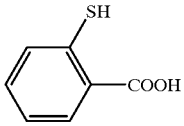
(2)-37
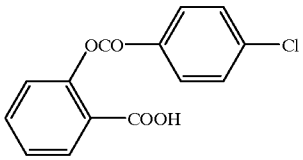
(2)-38
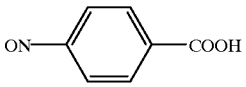
(2)-39
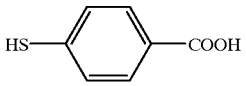
(2)-40
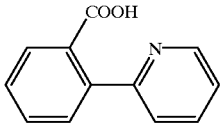
-continued
(2)-41
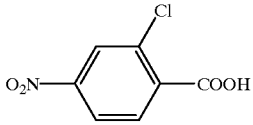
Exemplary examples of the compounds respresented by formula (3) are shown below, but are by no means limited to these.
(3)-1
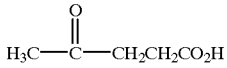
(3)-2
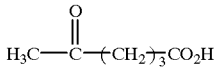
(3)-3
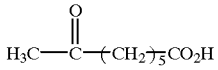
(3)-4
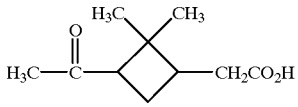
(3)-5
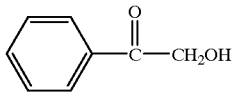
(3)-6
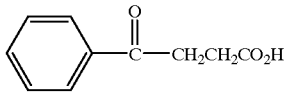
(3)-7
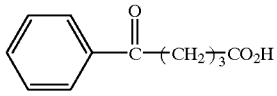
(3)-8
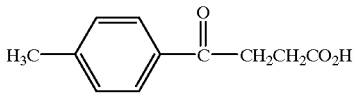
(3)-9
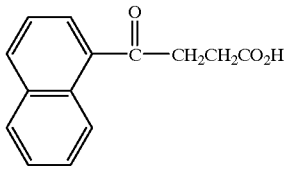
(3)-10
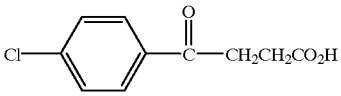

-continued
(3)-11
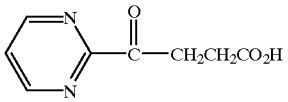
(3)-12
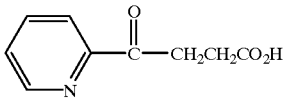
(3)-13
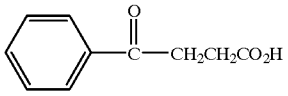
(3)-14
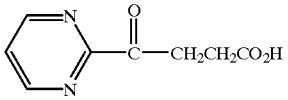
(3)-15
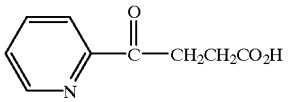
(3)-16
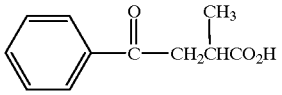
(3)-17
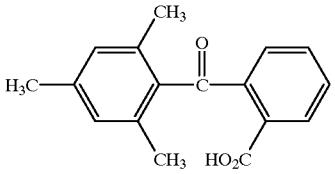
(3)-18
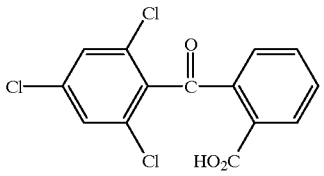
(3)-19
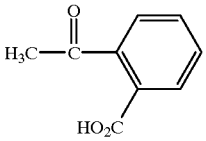
(3)-20
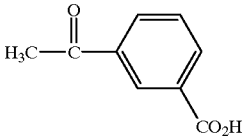
(3)-21
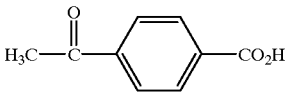
-continued
(3)-22
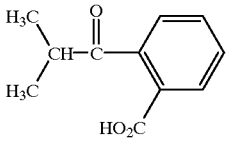
(3)-23
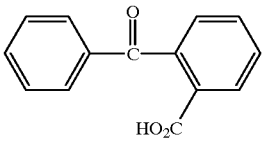
(3)-24
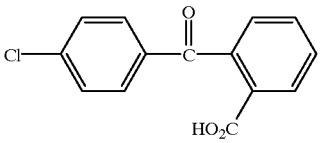
(3)-25
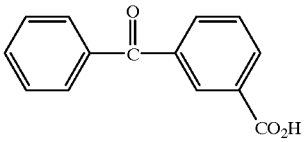
(3)-26
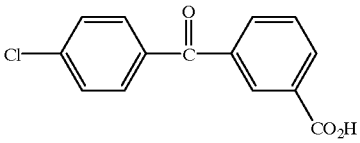
(3)-27
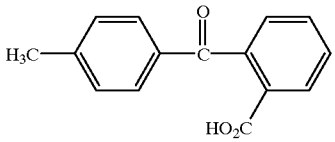
(3)-28
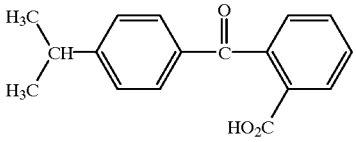
(3)-29
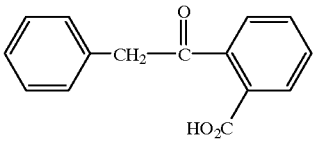
(3)-30
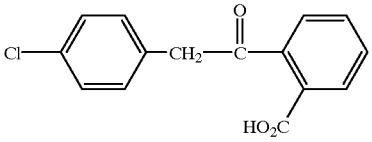

-continued (3)-31

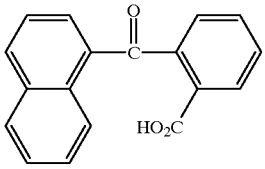

(3)-32

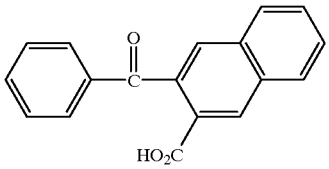

(3)-33

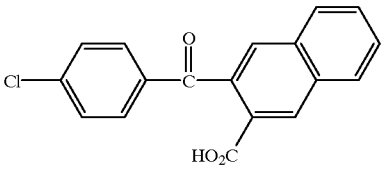

(3)-34

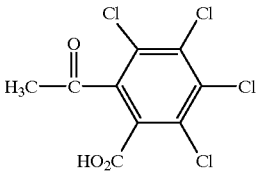

(3)-35

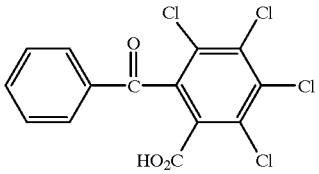

(3)-36

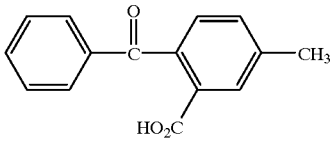

(3)-37

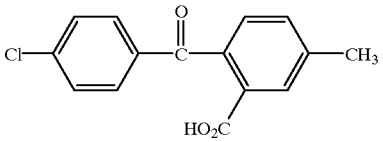

(3)-38

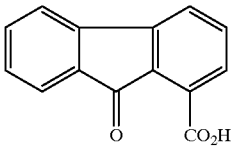

-continued (3)-39

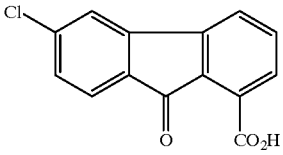

(3)-40

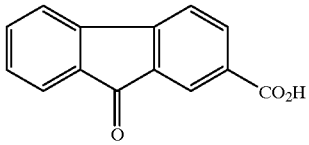

(3)-41

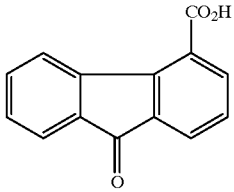

(3)-42

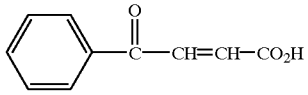

(3)-43

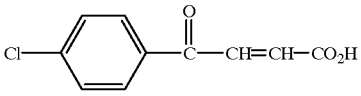

(3)-44

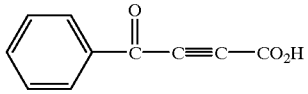

(3)-45

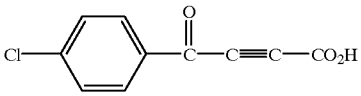

The compound represented by formula (1), which is also denoted as compd.(1), is incorporated in an amount of at least 0.005 mol/mol Ag, preferably 0.005 to 0.3 mol/mol Ag, and more preferably 0.01 to 0.15 mol/mol Ag. It is preferred that the compound represented by formula (2) or (3) be used in combination with the compound of formula (1). Concretely, with regard to the combination of compounds of formula (1) and (2), the compound of formula (2) is used in an amount of 5 to 100% by weight, and more preferably 10 to 50% by weight, based on the compound (1). With regard to the combination of compounds of formula (1) and (3), the compound of formula (3) is used in an amount of 5 to 300% by weight, and more preferably 10 to 150% by weight, based on the compound (1). With regard to the combination of compounds of formula (1), (2) and (3), the compound of formula (2) is used an amount of 5 to 100% by weight, and more preferably 10 to 50% by weight, and the compound of formula (3) is used in an amount of 5 to 300% by weight, and more preferably 10 to 150% by weight, based on the compound (1).

The compounds represented by formulas (1), (2) and (3) are commercially available and can also be synthesized according to the methods described in Chem. Pharm. Bulletin 31 (8), 2632 (1983); J. Chem. Soc., Section B Physical Organic Chemistry, Part. 1, pp. 145 to 149 (1971); J. Amer. Chem. Soc. 77, 1909 (1955), Org. Prep. proced. Int. 28 (5), 609 (1996), Chem. Ber. 44, 1236 (1911), J. Amer. Chem. Soc. 60, 2502 (1938); Bull. Soc. Khim. Fr. 25 (3), 173 (1901); Chem. Abstr. 9861 (1960); German Patent 2,970,18 and Justus Liebigs Ann. Chem. 300 299 (1898).

Silver halide grains work as a light sensor. In order to minimize cloudiness after image formation and to obtain excellent image quality, the less the average grain size, the more preferred, and the average grain size is preferably less than 0.1 μm, more preferably between 0.01 and 0.1 μm, and still more preferably between 0.02 and 0.08 μm. The grain size as described herein is defined as an edge length of silver halide grains, in cases where they are so-called regular crystals in the form of cube or octahedron. Furthermore, in cases where grains are not regular crystals, for example, spherical, cylindrical, and tabular grains, the grain size refers to the diameter of a sphere having the same volume as the silver grain. Furthermore, silver halide grains are preferably monodisperse grains. The monodisperse grains as described herein refer to grains having a monodispersibility obtained by the formula described below of less than 40%; more preferably less than 30%, and most. preferably from 0.1 to 20%.

Monodispersibility=(standard deviation of grain diameter)/(average grain diameter)×100(%)

In this invention, monodisperse silver halide grains having an average size of not more than 0.1 μm are preferred to enhance graininess of images.

The silver halide grain shape is not specifically limited, but a high ratio accounted for by a Miller index [100] plane is preferred. This ratio is preferably at least 50%; is more preferably at least 70%, and is most preferably at least 80%. The ratio accounted for by the Miller index [100] face can be obtained based on T. Tani, J. Imaging Sci., 29, 165 (1985) in which adsorption dependency of a [111] face or a [100] face is utilized.

Furthermore, another preferred silver halide shape is a tabular grain. The tabular grain as described herein is a grain having an aspect ratio represented by r/h of at least 3, wherein r represents a grain diameter in μm defined as the square root of the projection area, and h represents thickness in μm in the vertical direction. Of these, the aspect ratio is preferably between 3 and 50. The grain diameter is preferably not more than 0.1 μm, and is more preferably between 0.01 and 0.08 μm. The tabular grains can be prepared according to the methods described U.S. Pat. Nos. 5,264,337, 5,314,798 and 5,320,958. The use of the tabular grains in this invention also enhances image sharpness.

Halide composition is not specifically limited and any one of silver chloride, silver chlorobromide, silver iodochlorobromide, silver bromide, silver iodobromide and silver iodide is usable. Silver halide emulsions used in the invention can be prepared according to the methods described in P. Glafkides, Chimie Physique Photographique (published by Paul Montel Corp., 19679; G. F. Duffin, Photographic Emulsion Chemistry (published by Focal Press, 1966); V. L. Zelikman et al., Making and Coating of Photographic Emulsion (published by Focal Press, 1964). Silver halide relating to this invention is preferably contained in an amount of 0.75 to 30% by weight, based on an organic silver salt.

Silver halide used in this invention preferably occludes ions of metals belonging to Groups 6 to 11 of the Periodic Table. Preferred as the metals are W; Fe, Co, Ni, Cu, Ru, Rh, Pd, Re, Os, Ir, Pt and Au. These metals may be introduced into silver halide in the form of a complex. In the present invention, regarding the transition metal complexes, six-coordinate complexes represented by the general formula described below are preferred:

Formula:

$$(ML_6)^m:$$

wherein M represents a transition metal selected from elements in Groups 6 to 11. of the Periodic Table; L represents a coordinating ligand; and m represents 0, 1-, 2-, 3- or 4-. Exemplary examples of the ligand represented by L include halides (fluoride, chloride, bromide, and iodide), cyanide, cyanato, thiocyanato, selenocyanato, tellurocyanato, azido and aquo, nitrosyl, thionitrosyl, etc., of which aquo, nitrosyl and thionitrosyl are preferred. When the aquo ligand is present, one or two ligands are preferably coordinated. L may be the same or different.

Specifically preferred examples of M include rhodium (Rh), ruthenium (Ru), rhenium (Re), iridium (Ir) or osmium (Os).

Exemplary examples of transition metal ligand complexes are shown below:

1: $[RhCl_6]^{3-}$
2: $[RUCl_6]^{3-}$
3: $[ReCl_6]^{3-}$
4: $[RuBr_6]^{3-}$
5: $[OSCl_6]^{3-}$
6: $[IrCl_6]^{4-}$
7: $[Ru(NO)Cl_5]^{2-}$
8: $[(RuBr_4(H_2O)]^{2-}$
9: $[Ru(NO)(H_2O)Cl_4]^{-}$
10: $[RhCl_5(H_2O)]^{2-}$
11: $[Re(NO)Cl_5]^{2-}$
12: $[Re(NO)CN_5]^{2-}$
13: $[Re(NO)Cl(CN)_4]^{2-}$
14: $[Rh(NO)_2Cl_4]^{-}$
15: $[Rh(NO)(H_2O)Cl_4]^{-}$
16: $[Ru(NO)(CN)_5]^{2-}$
17: $[Fe(CN)_6]^{3-}$
18: $[Rh(NS)Cl_5]^{2-}$
19: $[Os(NO)Cl_5]^{2-}$
20: $[Cr(NO)Cl_5]^{2-}$
21: $[Re(NO)Cl_5]^{-}$
22: $[Os(NS)Cl_4(TeCN)]^{2-}$
23: $[Ru(NS)Cl_5]^{2-}$
24: $[Re(NS)Cl_4(SeCN)]^{2-}$
25: $[Os(NS)Cl(SCN)_4]^{2-}$
26: $[Ir(NO)Cl_5]^{2-}$
27: $[Ir(NS)Cl_5]^{2-}$

One type of these metal ions or complex ions may be employed and the same type of metals or the different type of metals may be employed in combinations of two or more types. Generally, the content of these metal ions or complex ions is suitably between $1\times10^{-9}$ and $1\times10^{-2}$ mole per mole of silver halide, and is preferably between $1\times10^{-8}$ and $1\times10^{-4}$ mole.

Compounds, which provide these metal ions or complex ions, are preferably incorporated into silver halide grains through addition during the silver halide grain formation. These may be added during any preparation stage of the silver halide grains, that is, before or after nuclei formation, growth, physical ripening, and chemical ripening. However, these are preferably added at the stage of nuclei formation, growth, and physical ripening; furthermore, are preferably added at the stage of nuclei formation and growth; and are most preferably added at the stage of nuclei formation.

These compounds may be added several times by dividing the added amount. Uniform content in the interior of a silver halide grain can be carried out. As disclosed in JP-A No. 63-29603, 2-306236, 3-167545, 4-76534, 6-110146, 5-273683, the metal can be distributively occluded in the interior of the grain.

These metal compounds can be dissolved in water or a suitable organic solvent (for example, alcohols, ethers, glycols, ketones, esters, amides, etc.) and then added. Furthermore, there are methods in which, for example, an aqueous metal compound powder solution or an aqueous solution in which a metal compound is dissolved along with NaCl and KCl is added to a water-soluble silver salt solution during grain formation or to a water-soluble halide solution; when a silver salt solution and a halide solution are simultaneously added, a metal compound is added as a third solution to form silver halide grains, while simultaneously mixing three solutions; during grain formation, an aqueous solution comprising the necessary amount of a metal compound is placed in a reaction vessel; or during silver halide preparation, dissolution is carried out by the addition of other silver halide grains previously doped with metal ions or complex ions. Specifically, the preferred method is one in which an aqueous metal compound powder solution or an aqueous solution in which a metal compound is dissolved along with NaCl and KCl is added to a water-soluble halide solution. When the addition is carried out onto grain surfaces, an aqueous solution comprising the necessary amount of a metal compound can be placed in a reaction vessel immediately after grain formation, or during physical ripening or at the completion thereof or during chemical ripening.

Silver halide grain emulsions used in the invention may be desalted after the grain formation, using the methods known in the art, such as the noodle washing method and flocculation process.

Photosensitive silver halide grains used in this invention is preferably subjected to a chemical sensitization. As is commonly known in the art, preferable chemical sensitizations include a sulfur sensitization, a selenium sensitization and a tellurium sensitization. Furthermore, a noble metal sensitization using gold, platinum, palladium and iridium compounds and a reduction sensitization are available. As the compounds preferably used in the sulfur sensitization, the selenium sensitization and the tellurium sensitization, well known compounds can be used and the compounds described in JP-A No. 7-128768 is usable. Examples of tellurium sensitizers include diacyltellurides, bis(oxycarbonyl)tellurides, bis(carbamoyl)tellurides, diacyltellurides, bis(oxycarbonyl)ditellurides, bis(carbamoyl9ditellurides, compounds containing a P═Te bonding, tellurocarboxylates, tellurocraboxylic acid esters, di(poly)tellurides, tellurides; tellurols, telluroacetals, tellurosulfonates, compounds containing a PTe bonding, Te-containing heterocycles, tellurocarbonyl compounds, inorganic tellurium compounds, and colloidal tellurium. Examples of the compounds used in the noble metal sensitization include chloroauric acid, potassium chloroaurate, potassium aurothiocyanate, gold sulfide, gold selenide, compounds described U.S. Pat. No. 2,448,060 and British Patent No. 618,061. Examples of the compounds used in the reduction sensitization include ascorbic acid, thiourea dioxide, stannous chloride, aminoiminomethane-sulfinic acid, hydrazine derivatives, borane compounds, silane compounds and polyamine compounds. The reduction sensitization can be carried out by ripening an emulsion with keeping the pH and pAg at not less than 7 and not more than 8.3, respectively. Furthermore, the reduction sensitization can be carried out by introducing a silver ion alone at a time during the grain formation.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1.2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides, of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. It is preferred to prepare a organic silver salt by double jet precipitation and controlled double jet addition in which silver nitrate and silver halide are simultaneously added at the stage of forming the organic silver salt. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form an aqueous organic silver salt dispersion. Further, the aqueous organic silver salt dispersion can also be prepared by the so-called controlled triple jet addition in which an alkali metal salt of an organic acid, silver nitrate and silver halide are simultaneously added. Preparation of an aqueous organic silver salt dispersion by the controlled double jet addition is preferably employed in terms of simplicity of the production process. Preparation of an aqueous organic silver salt dispersion by the controlled triple jet addition is also preferably employed to obtain high-speed photothermographic materials.

Reducing agents are preferably incorporated into the thermally developable photosensitive material of the present invention. Examples of suitable reducing agents are described in U.S. Pat. Nos. 3,770,448, 3,773,512, and 3,593,863, and Research Disclosure Items 17029 and 29963, and include the following: aminohydroxycycloalkenone compounds (for example, 2-hydroxypiperidino-2-cyclohexane); esters of amino reductones as the precursor of reducing agents (for example, piperidinohexose reducton monoacetate); N-hydroxyurea derivatives (for example, N-p-methylphenyl-N-hydroxyurea); hydrazones of aldehydes or ketones (for example, anthracenealdehyde phenylhydrazone; phosphamidophenols; phosphamidoanilines; polyhydroxybenzenes (for example, hydroquinone, t-butylhydroquinone, isopropylhydroquinone, and (2,5-dihydroxyphenyl)methylsulfone); sulfydroxamic acids (for example, benzenesulfhydroxamic acid); sulfonamidoanilines (for example, 4-(N-methanesulfonamide)aniline); 2-tetrazolylthiohydroquinones (for example, 2-methyl-5-(1-phenyl-5-tetrazolylthio)hydroquinone); tetrahydroquinoxalines (for example, 1,2,3,4-tetrahydroquinoxaline); amidoxines; azines (for example, combinations of aliphatic carboxylic acid arylhydrazides with ascorbic acid); combinations of polyhydroxybenzenes and hydroxylamines, reductones and/or hydrazine; hydroxamic acids; combinations of azines with sulfonamidophenols; α-cyanophenylacetic acid derivatives; combinations of bis-β-naphthol with 1,3-dihydroxybenzene derivatives; 5-pyrazolones, sulfonamidophenol reducing agents, 2-phenylindane-1,3-dione, etc.; chroman; 1,4-dihydropyridines (for example, 2,6-dimethoxy-3,5-dicarboethoxy-1,4-dihydropyridine); bisphenols (for example, bis(2-hydroxy-3-t-butyl-5-methylphenyl)methane, bis(6-hydroxy-m-tri)mesitol, 2,2-bis(4-hydroxy-3-methylphenyl)propane, 4,5-ethylidene-bis(2-t-butyl-6-methyl)phenol, UV-sensitive ascorbic acid derivatives and 3-pyrazolidones. Of these, particularly preferred reducing agents are hindered phenols. The hindered phenols include a compound represented by the following formula (A):

Formula (A)

Formula (A)

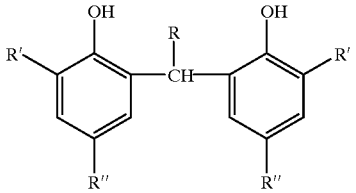

wherein R represents a hydrogen atom or an alkyl group having from 1 to 10 carbon atoms (for example, —$C_4H_9$, 2,4,4-trimethylpentyl), and R' and R" each represents an alkyl group having from 1 to 5 atoms (for example, methyl, ethyl, t-butyl).

Exemplary examples of the compounds represented by the formula (A) are shown.

A-1

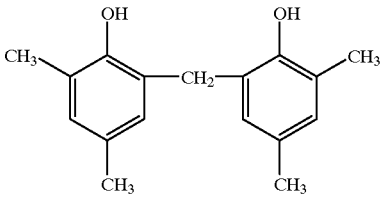

-continued

A-2

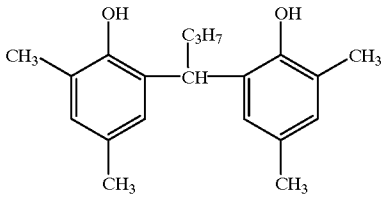

A-3

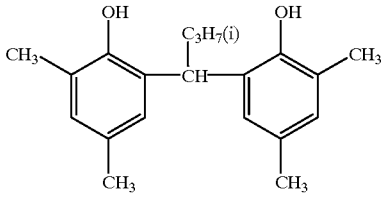

A-4

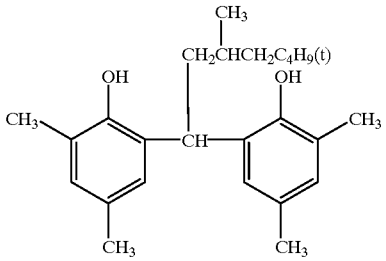

A-5

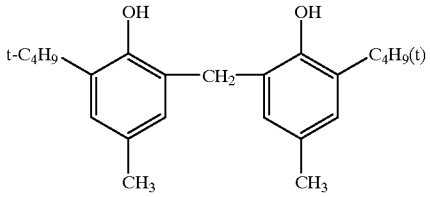

A-6

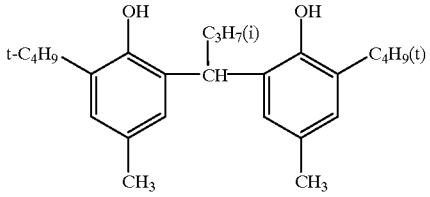

A-7

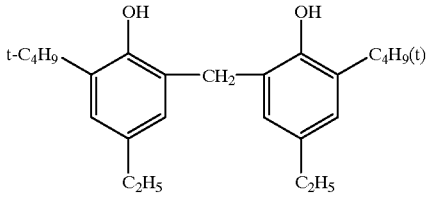

The reducing agent represented by the above-mentioned general formula (A) is preferably used in an amount of $1\times10^{-2}$ and 10 moles, and more preferably $1\times10^{-2}$ and 1.5 moles per mole of silver.

Antifoggants may be incorporated into the thermally developable photosensitive material to which the present invention is applied. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and Japanese Patent Publication Open to Public Inspection No. 59-57234.

Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. As examples of suitable antifoggants, employed preferably are compounds described in paragraph numbers [0062] and [0063] of. JP-A No. 9-90550. Furthermore, other suitable antifoggants are disclosed in U.S. Pat. No. 5,028,523, and European Patent.Nos. 92221383. Nos. 600,587, 605,981 and 631,176.

Image toning agents are preferably incorporated into the thermally developable photosensitive material used in the present invention. Examples of preferred image toning agents are disclosed in Research Disclosure Item 17029, and include the following:

imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene-(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid. sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a,5,6a-tatraazapentalene) Preferred image color control agents include phthalazone or phthalazine.

In the thermally developable photosensitive material of the present invention, employed can be sensitizing dyes described, for example, in JP-A Nos. 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A Nos. 9-34078, 9-54409 and 9-80679 are preferably employed.

The photothermographic materials used in this invention may contain a mercapto compound, disulfide compound or thione compound to inhibit or accelerate development, to enhance spectral sensitization efficiency, or to enhance storage stability of the unprocessed photographic material.

In the present invention, to restrain or accelerate development for the purpose of controlling the development, to enhance the spectral sensitive efficiency, or to enhance the reservation stability before and after the development, a mercapto compound, a disulfide compound and a thione compound can be incorporated in the photosensitive material. In cases where the mercapto compound is used in the present invention, any compound having a mercapto group can be used, but preferred compounds are represented by the following formulas, Ar—SM and Ar—S—S—Ar, wherein M represents a hydrogen atom or an alkaline metal atom, Ar represents an aromatic ring compound or a condensed aromatic ring compound having at least a nitrogen, sulfur, oxygen, selenium or tellurium. Preferable aromatic heterocyclic ring compounds include benzimidazole, naphthoimidazole, benzothiazole, naphthothiazole, benzoxazole, naphthooxazole, benzoselenazole, benzotellurazole, imidazole, oxazole, pyrazole, triazole, thiadiazole, tetrazole, triazine, pyrimidine, pyridazine, pyrazine, pyridine, purine, quinoline or quinazoline. These aromatic heterocyclic ring compounds may contain a substituent selected from a halogen atom (e.g., Br and Cl), a hydroxy group, an amino group, a carboxy group, an alkyl group (e.g., alkyl group having at least a carbon atom, preferably 1 to 4 carbon atoms) and an alkoxy group (e.g., alkoxy group having at least a carbon atom, preferably 1 to 4 carbon atoms). Examples of mercapto-substituted aromatic heterocyclic ring compounds include 2-mercaptobenzimidazole, 2-mercaptobenzoxazole, 2-mercaptobenzothiazole, 2-mercapto-5-methylbenzothiazole, 3-mercapto-1,2,4-triazole, 2-mercaptoguinoline, 8-mercaptopurine, 2,3,5,6-tetrachloro-4-pyridinethiol, 4-hydroxy-2-mercaptopyrimidine and 2-mercapto-4-phenyloxazole, but the exemplified compounds according to the present invention are not limited thereto.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 10 percent in weight ratio with respect to the total binder in the emulsion layer side.

Materials of the matting agents employed in the present invention may be either organic substances or inorganic substances. Regarding inorganic substances, for example, those can be employed as matting agents, which are silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Regarding organic substances, as organic matting agents those can be employed which are starch described in U.S. Pat. No. 2,322,037, etc.;

starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere which has the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the image forming layer, and is more preferably incorporated into the farthest layer from the support surface.

Addition methods of the matting agent include those in which a matting agent is previously dispersed into a coating composition and is then coated, and prior to the completion of drying, a matting agent is sprayed. When plural matting agents are added, both methods may be employed in combination.

To improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14 through 20, are preferably used.

Various kinds of additives can be incorporated into a photosensitive layer, a non-photosensitive layer or other construction layers. Except for the compounds mentioned above, surface active agents, antioxidants, stabilizers, plasticizers, UV (ultra violet rays) absorbers, covering aids, etc. may be employed in the thermally developable photosensitive material according to the present invention. These additives along with the above-mentioned additives are described in Research Disclosure Item 17029 (on page 9 to 15, June, 1978) and can be employed.

In order to promote the thermal development rate, the amount of a binder used in the photosensitive layer is preferably 1.5 to 10g/m$^2$ and more preferably 1.7 to 8 g/m$^2$.

Supports employed in the present invention are preferably, in order to minimize the deformation of images after development processing, plastic films (for example, polyethylene terephthalate, polycarbonate, polyimide, nylon, cellulose triacetate, polyethylene naphthalate).

Preferred supports include polyethylene terephthalate (hereinafter, also denoted as PET) and a plastic resin support containing a styrene type polymer having a syndiotactic structure (hereinafter, also denoted as SPS). The thickness of the support is within a range of 50 to 300 $\mu$m, and preferably 70 to 180 $\mu$m. Thermally treated plastic resin supports can also be employed, in which the plastic resins described above are used. The supports are thermally treated at any time after film-making and before coating the photosensitive layer, at a temperature higher by at least 30° C. (preferably at least 35° C., and more preferably at least 40° C.) than the glass transition point of the support. When heated at a temperature higher than a melting point, effects of the invention cannot be achieved.

Next, plastic resins will be explained. PET is comprised of polyethylene terephthalate as a polyester component. Besides polyethylene terephthalate, an acid component such as terephthalic acid, naphthalene-2,6-dicarboxylic acid, isophthalic acid, butylenedicarboxylic acid, 5-(sodiumsulfo)isophthalic acid or adipinic acid, or a glycol component such as ethylene glycol, propylene glycol, butanediol or cyclohexanedimethanol may be contained as a modifying component, in an amount of not more than 10%, based on the total polyester. SPS which is different from conventional polystyrene (atactic polystyene), is a polystyrene having stereoregularity (i.e., tacticity). The stereoregular portion of SPS is called a recemo chain, in which a two-chained, three-chained, five-chained, or more chained stereoregular portion are preferred. In this invention, the recemo chain is preferably at least 85% of two chains, at least 75% of three chains, at least 50% of five chains or at least 30% of more chains. Polymerization of SPS can be carried out according to the method described in JP-A No. 3-131843. Film-making and Subbing of the support used in this invention can be conducted by the commonly known method, and preferably by the method described in JP-A No. 9-50094, col. [0030] through [0070].

The photothermographic materials relating to this invention are thermally developed to form photographic images, which comprise a reducible silver source (e.g., an organic silver salt), a catalytically active amount of photocatalyst (e.g., silver halide) and a reducing agent, which are contained in the form of a dispersion in an organic binder matrix. The photothermographic material is stable at ordinary temperature and forms silver through an oxidation-reduction reaction between a reducible silver source (functioning as an oxidant) and a reducing agent when exposed and heated at a high temperature (e.g., 80° C. or higher). The oxidation-reduction reaction is promoted by catalytic action of the latent image produced by exposure to light. Silver formed from the reaction of the organic silver salt in the exposed area provides a black image which is contrasted with the unexposed area, leading to image information. The reaction proceeds without supplying any processing solution such as water from the outside.

The photothermographic material comprises at least a photosensitive layer on the support. There may be provided the photosensitive layer alone on the support but at least a non-photosensitive layer is preferably provided on the photosensitive layer. There may be provided a filter dye layer on the photosensitive layer-side to control the amount or the wavelength distribution of light transmitting the photosensitive layer and/or an antihalation dye layer (so-called backing layer) on the opposite side. Any dye compound can be employed, which has an intended absorption within a desired wavelength region. Examples of preferred compounds thereof include JP-A Nos. 59-6481 and 59-182436, U.S. Pat. Nos. 4,271,263 and 4,594,312, European Patent NO. 533,008A and 652,473A, JP-A Nos. 2-216140, 4-348339, 7-191432 and 7-301890. Such a non-photosensitive layer preferably contains a binder or a matting agent, or a lubricant such as polysiloxane compounds, wax or a liquid paraffin.

The photosensitive layer may be comprised of plural layers and a layer arrangement such as high speed layer/low speed layer or low speed layer/high speed layer can be provided to adjust the contrast.

Photothermographic materials used in this invention are disclosed in detail described in D. Morgan & B. Sherry, U.S. Pat. Nos. 3,152,904 and 3,487,075, D. Morgan "Dry Silver Photographic Material", and D. H. Klosterboer "Thermally Processed Silver Systems" (Imaging Processes and Materials) Neblette, 8th Edition, edited by Sturge, V. Walworth, and A. Shepp, page 279, 1989), etc. The photothermographic materials are characterized in that images are formed upon heating at 80 to 140° C. without fixing, therefore, silver halide and an organic silver salt in unexposed areas remain as such are without being removed. After being thermally processed, the photothermographic material preferably exhibits a total optical transmission density at 400 nm (including a support) of not more than 0.2 and more preferably 0.02 to 0.2.

EXAMPLES

The present invention will be further described based examples, but embodiments of the invention are by no means limited to these.

Example 1

Preparation of Photographic Support

Both sides of a blue-tinted 175 μm thick PET film exhibiting a density of 0.17 (which was measured with a densitometer PDA-65, available from Konica Corp.) were subjected to corona discharge at 8 $W/m^2 \cdot min$.

Preparation of Photosensitive Silver Halide Emulsion 1

In 900 ml of deionized water were dissolved 7.5 g of ossein gelatin (having an average molecular weight of 100,000) and 10 mg of potassium bromide. After adjusting the temperature and the pH to 35° C. and 3.0, respectively, 370 ml of an aqueous solution containing 74 g silver nitrate and an equimolar aqueous solution containing potassium bromide, potassium iodide (in a molar ratio of 98 to 2) and $1\times10^{-4}$ mol/mol Ag of iridium chloride were added over a period of 10 minutes by the controlled double-jet method, while the pAg was maintained at 7.7. Thereafter, 0.3 g of 4-hydroxy-6-methyl-1,3,3a,7-tetraazaindene was added and the pH was adjusted to 5 using NaOH. There was obtained cubic silver iodobromide grains having an average grain size of 0.06 μm, a variation coefficient of the projection area equivalent diameter of 12 percent, and the proportion of the {100} face of 87 percent. The resulting emulsion was flocculated to remove soluble salts, employing a flocculating agent and after desalting, 0.1 g of phenoxyethanol was added and the pH and pAg were adjusted to 5.9 and 7.5, respectively to obtain silver halide emulsion 1.

Preparation of Powdery Organic Silver Salt

In 4720 ml water were dissolved 111.4 g of behenic acid, 83.8 g of arachidic acid and 54.9 g of stearic acid at 80° C. The, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion (equivalent to 0.038 mol silver) and 450 ml water and stirring further continued for 5 min., while maintained at a temperature of 55° C. Subsequently, 760.6 ml of 1M aqueous silver nitrate solution was added in 2 min. and stirring continued further for 20 min., then, the reaction mixture was filtered to remove aqueous soluble salts. Thereafter, washing with deionized water and filtration were repeated until the filtrate reached a conductivity of 2 μS/cm, and after subjecting to centrifugal dehydration, the reaction product was dried with heated air at 37° C. until no reduction in weight was detected to obtain a powdery organic silver salt.

Preparation of Photosensitive Emulsion-dispersing Solution

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver type homogenizer. Thereafter, the mixture was dispersed using a media type dispersion machine (available from Gettzmann Corp.), which was packed 1 mm Zr beads (available from Toray Co. Ltd.) by 80%, at a circumferential speed of 13 m and for 0.5 min. of a retention time with a mill to obtain a photosensitive emulsion dispersing solution.

Preparation of Photosensitive Layer Coating Solution

To 500 g. of the photosensitive emulsion dispersing solution, 100 g of methyl ethyl ketone (MEK) was added with stirring and maintained at 21° C. Antifoggant 1 described below (0.20 g) was added thereto and stirred for 1 hr.; then, calcium bromide (3.25 ml of 10% methanol solution) was further added and stirred for 30 min. Subsequently, sensitizing dye 1, compounds of formula (1), (2) and/or (3) [mixing ratio of 1:250–450:20, MEK solution of 0.1% sensitizing dye] were added and stirred for 1 hr. Thereafter, the temperature was lowered to 13° C. and further stirred for 30 min. Further thereto, 48 g of polyvinyl butyral was added and dissolved, while being maintained at 13° C., and the following additives were added:

| | |
|---|---|
| A-3 (reducing agent) | 15 g |
| Desmodu N3300 (aliphatic isocyanate, available from Movey Corp.) | 1.10 g |
| Anti-printing-out agent | 1.55 g |
| Phthalazine | 1.5 g |
| Tetrachlorophthalic acid | 0.5 g |
| 4-Methylphthalic acid | 0.5 g |

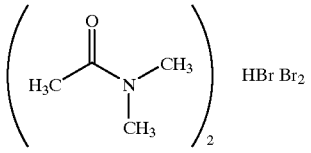

Antifoggant 1

-continued

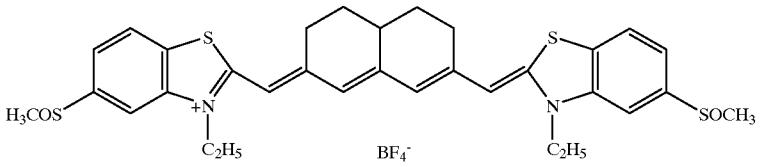

Sensitizing dye 1

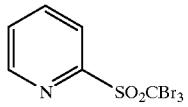

Anti-printing-out agent

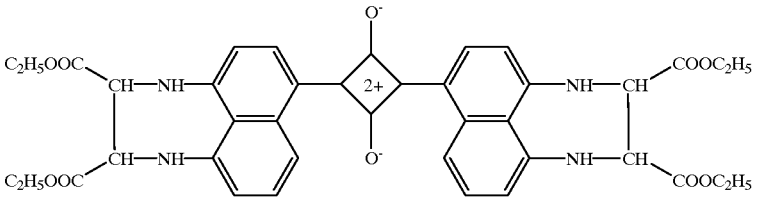

Infrared dye 1

After preparing the coating solution of the photosensitive layer, it was maintained at 13° C. and coating was conducted as follows. Thus, on the support, the following layers were successively formed to prepare a photothermographic material sample. Drying was carried out at 75° C. for 5 min.

Back Layer Coating

To 830 g of methyl ethyl ketone were added with stirring 84.2 g of cellulose acetate butylate (CAB381-20, available from Eastman Chemical Corp.) and 4.5 g of polyester resin (Vitel PE2299B, available from Bostic Corp.). Further thereto was added 0.30 g of infrared dye 1, then, 4.5 g of a fluorinated surfactant (SURFLON KH40, available from ASAHI Glass Co., Ltd.), which was dissolved in 43.2 g methanol, and 2.3 g of a fluorinated surfactant (MEGAFAC F120K, available from DAINIPPON INK Co., Ltd.) was added and stirred until sufficiently dissolved. Finally, 75 g of silica (Siloid 64×6000, available. from W.R. Grace Corp.) which was dispersed in methyl ethyl ketone in a concentration of 1% by weight by a dissolver type homogenizer, was added and stirred to obtain a coating solution of a back layer. The thus prepared coating solution of the back layer was coated using an extrusion coater so that the resulting dry layer thickness was 3.5 $\mu$m. Drying was carried out using hot air at a temperature of 100° C. and a dew point of 10° C. for a period of 5 min.

The photosensitive layer coating solution and surface protective layer coating solution were simultaneously coated using an extrusion coater at a coating speed of 20 m/min so that a silver coverage of the photosensitive layer was 2.0 g/m$^2$ and a dry thickness of the protective layer was 2.5 $\mu$m.

Photosensitive Layer Coating

The photosensitive layer coating solution was coated so that a silver coverage was 2.0 g/m$^2$ and a binder of polyvinyl butyral was 8.5 g/m$^2$.

Protective Layer Coating

Coating solution

| | |
|---|---|
| Acetone | 5 ml/m$^2$ |
| Methyl ethyl ketone | 21 ml/m$^2$ |
| Cellulose acetate butylate | 2.3 g/m$^2$ |
| Methanol | 7 ml/m$^2$ |
| Phthalazinone | 250 mg/m$^2$ |
| Matting agent: monodisperse silica having an average particle size of 4 $\mu$m and monodispersity of 10% | 70 mg/m$^2$ |
| $CH_2{=}CH{-}SO_2{-}(CH_2)_2{-}O{-}(CH_2)_2SO_2{-}CH{=}CH_2$ | 35 mg/m$^2$ |
| $C_9F_{19}{-}C_6H_4{-}SO_3Na$ | 10 mg/m$^2$ |

Exposure and Processing

The thus prepared photothermographic material samples were each subjected to laser scanning exposure from the emulsion side using an exposure apparatus having a light source of 800 to 820 nm semiconductor laser of longitudinal multi-mode, which was made by means of high frequency overlapping. In this case, exposure was conducted at an angle between the exposed surface and exposing laser light was 75° and in an atmosphere at a temperature of 23° C. and 50% RH (and as a result, images with superior sharpness were unexpectedly obtained, as compared to exposure at an angle of 90°).

Using an automatic processor provided with a heated drum, thereafter, exposed samples were subjected to thermal development at 123° C. for 16.5 sec., while bringing the protective layer surface of the photothermographic material into contact with the drum surface. The exposure and thermal development was conducted in an atmosphere at 23° C. and 50% RH. The thus thermally developed samples each were subjected to sensitometry using a densitometer and evaluated with respect to sensitivity (denoted as S) and a fog density (denoted as Fog). The sensitivity was represented by a relative value of reciprocal of exposure necessary to give a density of fog plus 1.0, based on the sensitivity of Sample 1 being 100.

Evaluation of Film Storage Stability

Of two sheets of each film sample, one of them (i.e., fresh sample) was exposed and processed immediately after completion of coating and the other one was exposed and processed after allowed to age at 25° C. and 55% RH for 3 days (i.e., aged sample. Both processed sheets were subjected to densitometry to determine sensitivity and a fog density. Results are shown in Table 1 .

Storage stability of photothermographic material samples was evaluated based on an increase in sensitivity (ΔS) and an increase in fog (Δfog) defined as below:

Sensitivity increase (ΔS)=sensitivity of aged sample minus sensitivity of fresh sample Fog increase (ΔS)=fog density of aged sample minus fog density of fresh sample.

TABLE 1

| Sample No. | Compound (mol/Ag mol) | Compound (mol/Ag mol) | Compound (mol/Ag mol) | S | Fog | Storage Stability ΔS | Storage Stability ΔFog | Remark |
|---|---|---|---|---|---|---|---|---|
| 1 | — | — | (3)-24 (0.1) | 100 | 0.09 | 15 | 0.05 | Comp. |
| 2 | — | (2)-30 | — (0.1) | 123 | 0.16 | 25 | 0.09 | Comp. |
| 3 | (1)-27 | — | — (0.1) | 90 | 0.04 | −5 | −0.01 | Inv. |
| 4 | (1)-27 (0.05) | (2)-30 (0.05) | — | 110 | 0.08 | 10 | 0.04 | Inv. |
| 5 | (1)-27 (0.05) | — | (3)-24 (0.05) | 98 | 0.06 | 7 | 0.03 | Inv. |
| 6 | (1)-27 (0.08) | (2)-30 (0.02) | — | 100 | 0.05 | 7 | 0.03 | Inv. |
| 7 | (1)-27 (0.08) | — | (3)-24 (0.02) | 96 | 0.04 | 5 | 0.02 | Inv. |
| 8 | (1)-27 (0.1) | (2)-30 (0.02) | — | 102 | 0.04 | 4 | 0.02 | Inv. |
| 9 | (1)-27 (0.1) | — | (3)-24 (0.02) | 100 | 0.04 | 3 | 0.02 | Inv. |
| 10 | (1)-27 (0.125) | (2)-30 (0.025) | — | 99 | 0.04 | 1 | 0 | Inv. |
| 11 | (1)-27 (0.125) | — | (3)-24 (0.025) | 98 | 0.04 | 0 | 0 | Inv. |

As apparent from Table 1, inventive samples exhibited a lower fog level, enhanced sensitivity and improved storage stability, relative to comparative samples.

Example 2

Photothermographic material samples used in in Example 1 (No. 1 through 11) were exposed and processed similarly to Example 1. The thus processed samples were attached to the inside of a glass window exposed to direct sunlight and allowed to stand for a period of one month. The resulting samples (denoted as Sample No. 12 through 22) were visually evaluated with respect to light fastness of images, based on the following criteria:

A: substantially no change observed,

B: slightly change in tone but sufficiently acceptable in practical use,

C: observed change in image color but still acceptable level in practical use, and D: color change in Dmin, increased Dmin and unacceptable in practical use.

Herein, the Dmin is defined as a density of an unexposed area including a density of the support.

TABLE 2

| Sample No. | Light Fastness | Remark |
|---|---|---|
| 12 | C | Comp. |
| 13 | D | Comp. |
| 14 | B | Inv. |
| 15 | B | Inv. |
| 16 | A | Inv. |
| 17 | A | Inv. |
| 18 | A | Inv. |
| 19 | A | Inv. |

TABLE 2-continued

| Sample No. | Light Fastness | Remark |
|---|---|---|
| 20 | A | Inv. |
| 21 | A | Inv. |
| 22 | A | Inv. |

As can be seen From Table 2, inventive samples exhibited superior light fastness, relative to comparative samples.

Example 3

Preparation of a Subbed PET Photographic Support

Both surfaces of a biaxially stretched thermally fixed 100 μm PET film, available on the market, was subjected to corona discharging at 8 w/m$^2$·min. Onto the surface of one side, the subbing coating composition a-1 descried below was applied so as to form a dried layer thickness of 0.8 μm. which was then dried. The resulting coating was designated Subbing Layer A-1. Onto the opposite surface, the subbing coating composition b-1 described below was applied to form a dried layer thickness of 0.8 μm. The resulting coating was designated Subbing Layer B-1.

| Subbing Coating Composition a-1 | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis (ethyleneurea) | 0.8 g |
| Water to make | 1 liter |

| Subbing Coating composition b-1 | |
|---|---|
| Latex liquid (solid portion of 30%) of a copolymer consisting of butyl acrylate (40 weight %) styrene (20 weight %) glycidyl acrylate (25 weight %) | 270 g |
| (C-1) | 0.6 g |
| Hexamethylene-1,6-bis (ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.1 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2 .

Upper Subbing Layer Coating Composition a-2

Gelatin in an amount (weight) to make 0.4 g/m$^2$

| | |
|---|---|
| (C-1) | 0.2 g |
| (C-2) | 0.2 g |
| (C-3) | 0.1 g |
| Silica particles (av. size 3 $\mu$m) | 0.1 g |
| Water to make | 1 liter |

| Upper Subbing Layer Coating Composition b-2 | |
|---|---|
| (C-4) | 60 g |
| Latex solution (solids 20%, comprising (C-5) as a component | 80 g |
| Ammonium sulfate | 0.5 g |
| (C-6) | 12 g |
| Polyethylene glycol (average molecular weight of 600) | 6 g |
| Water to make | 1 liter |

(C-1)

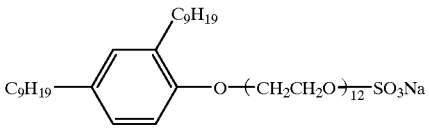

-continued (C-2)

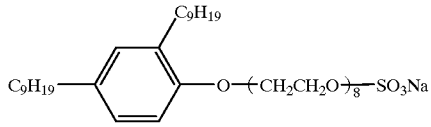

(C-3)

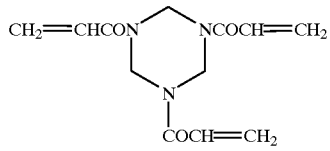

(C-4)

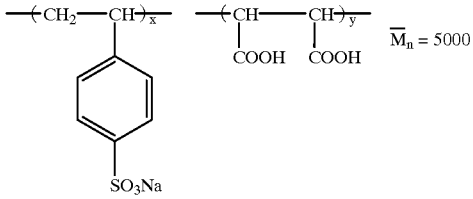

($\overline{M}$n is a number average molecular weight)

x:y=75:25 (weight ratio)

(C-5)

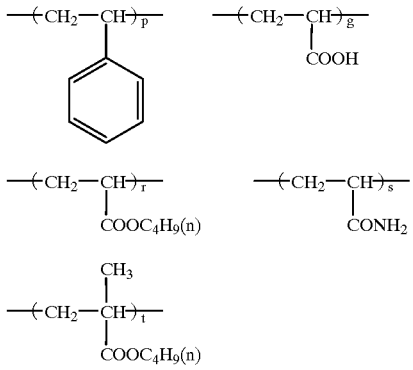

p:g:r:s:t=40:5:10:5:40 (weight ratio)

(C-6)

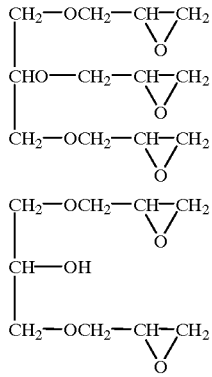

-continued

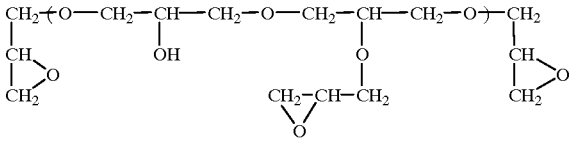

Mixture consisting of the three compounds illustrated above

Preparation of Backing Coat Composition

To 830 g of methyl ethyl ketone (MEK), 84.2 g of cellulose acetate-butylate (CAB381-20, available from Eastman Chemical Co.) and 4.5 g of polyester resin (Vitel PE2200B, available from Bostic Corp.) was added with stirring and dissolved therein. To the resulting solution was added 0.30 g of infrared dye 1 (which was the same as used in the photosensitive layer described later) and 4.5 g fluorinated surfactant (Surflon KH40, available from ASAHI Glass Co. Ltd.) and 2.3 g fluorinated surfactant (Megafag F120K, available from DAINIPPON INK Co. Ltd.) which were dissolved in 43.2 g methanol, were added thereto and stirred until being dissolved. Then, 75 g of silica (Siloid 64x6000, available from W.R. Grace Corp.), which was dispersed in methyl ethyl keton in a concentration of 1 wt % using a dissolver type homogenizer, was further added thereto with stirring to obtain a coating composition for backing layer.

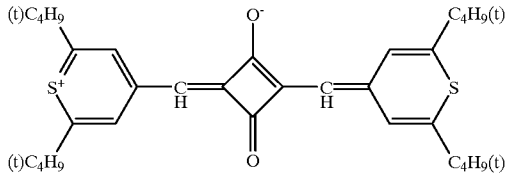

Coating of Backing Layer

The thus prepared coating composition for a backing layer was coated by an extrusion coater and dried so as to have dry thickness of 3.5 μm and dried at a dry-bulb temperature of 100° C. and a wet-bulb temperature of 10° C. over a period of 5 min.

| Preparation of Light Sensitive Silver halide emulsion A | |
|---|---|
| Solution A1 | |
| Phenylcarbamoyl gelatin | 88.3 g |
| Compound A (10% methanol solution) | 10 ml |
| Potassium bromide | 0.32 g |
| Water to make | 5429 ml |
| Solution B1 | |
| 0.67 mol/l Silver nitrate solution | 2635 ml |
| Solution C1 | |
| Potassium bromide | 51.55 g |
| Potassium iodide | 1.47 g |
| Water to make | 660 ml |
| Solution D1 | |
| Potassium bromide | 154.9 g |
| Potassium iodide | 4.41 g |
| Iridium chloride (1% solution) | 0.93 ml |
| Water to make | 1982 ml |

-continued

| Preparation of Light Sensitive Silver halide emulsion A | |
|---|---|
| Solution E1 | |
| 0.4 mol/l Potassium bromide solution used for adjusting silver potential | |
| Solution F1 | |
| Potassium hydroxide | 0.71 g |
| Water to make | 20 ml |
| Solution G1 | |
| 56% Acetic acid aqueous solution | 18.0 ml |
| Solution H1 | |
| Anhydrous sodium carbonate | 1.72 g |
| water to make | 151 ml |

Compound A $HO(CH_2CH_2O)n[CH(CH_3)CH_2]_{17}(CH_2CH_2O)mH$
m+n=5 to 7

Using a stirring mixer described in JP-B Nos. 58-58288 and 58-58289 and to solution A1 were added a quarter of solution B1 and the total amount of solution C1 by the double jet addition in 4 min. 45 sec. to form nucleus grains, while the temperature and pAg were maintained at 45° C. and 8.09, respectively. After 1 min, solution F1 was added, while the pAg was optimally adjusted using solution E1. After 6 min., remaining solution $B_1$ and solution D were added by the double jet addition in 14 min. 15 sec., while the temperature and pAg were maintained at 45° C. and 8.09, respectively. After stirring for 5 min., the temperature was lowered to 40° C. and solution G1 was added to cause the emulsion to coagulate. Leaving 2000 ml, the supernatant was removed, then, 10 lit. water was added and after stirring, emulsion was coagulated. Leaving 1500 ml, the supernatant was removed and solution H1 was added. Then, the temperature was raised to 60° C. and stirring continued for 120 min. Finally, the pH was adjusted 5.8 and water was further added so as to be 1161 g per mol of silver to obtain a light sensitive silver halide emulsion A.

The emulsion was comprised of monodisperse silver iodobromide grains having a mean size of 0.058 μm and exhibiting a variation coefficient of grain size of 12% and a (100) face ratio of 92%.

Preparation of Powdery Organic Silver Salt

In 4720 ml water were dissolved 111.4 g of behenic acid, 83.8 g of arachidic acid and 54.9 g of stearic acid at 80° C. Then, after adding 540.2 ml of 1.5M aqueous sodium hydroxide solution with stirring and further adding 6.9 ml of concentrated nitric acid, the solution was cooled to a temperature of 55° C. to obtain an aqueous organic acid sodium salt solution. To the solution were added the silver halide emulsion obtained above (equivalent to 0.038 mol silver) and 450 ml water and stirring further continued for 5 min., while maintained at a temperature of 55° C. Subsequently, 702.6 ml of 1M aqueous silver nitrate solution was added in 2 min. and stirring continued further for 10 min., then, the reaction mixture was filtered to remove aqueous soluble salts. Thereafter, washing with deionized water and filtration were repeated until the filtrate reached a conductivity of 2 μS/cm, and then subjected to centrifugal dehydration. Using a flash jet dryer (produced by Seishin Kigyo Co., Ltd.), the thus obtained cake-like organic silver salt was dried under an atmosphere of inert gas (i.e., nitrogen gas), according to the operation condition of a hot air temperature at the inlet of the dryer until reached a moisture content of 0.1%. The moisture content was measured by an infrared ray aquameter.

Preparation of Preliminary Dispersion A

In 1457 g methyl ethyl ketone was dissolved 14.57 g of polyvinyl butyral powder (Butvar B-79, available from Monsanto Corp.) and further thereto was gradually added 500 g of the powdery organic silver salt with stirring by a dissolver type homogenizer, DISPERMAT CA-40M (available from VMA-GETZMANN Corp.)

Preparation of Light Sensitive Emulsion 1

Thereafter, the preliminary dispersion A was further dispersed using a media type dispersion machine (available from GETZMANN Corp.), which was packed 1 mm Zr beads (available from Toray Co. Ltd.) by 80%, at a circumferential speed of 8 m/s of a retention time with a mill to obtain light sensitive emulsion dispersing solution 1.

Preparation of Stabilizer Solution

Stabilizer-1 of 1.0 g and potassium acetate of 0.31 g were dissolved in 4.97 g of methanol to prepare a stabilizer solution Stabilizer-1

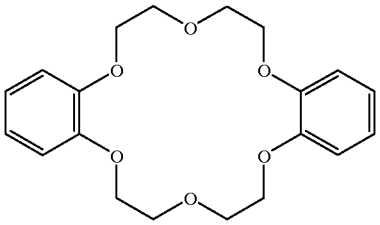

Preparation of Infrared Sensitizing Dye Solution A

Sensitizing dye 1 (of 31.3 ml of 0.1% MEK solution) was dissolved in a mixture solution of compounds of general formulas (1), (2) and (3), and 5-methyl-2-mercaptobenzimidazole in the dark room to obtain infrared sensitizing dye solution A.

Preparation of Additive Solution a

Developer 1,1-bis(2-hydroxy-3,5-dimethylphenyl)-2-methylpropane of 27.98 g, 1.54 g of 4-methylphthalic acid and 0.48 g of infrared sensitizing dye 1 were dissolved in 110 g of MEK to obtain additive solution a.

Preparation of Additive Solution b

Antifoggant-1 of 1.78 g, antifoggant-2 of 1.78 g and 3.43 g of phthalazine were dissolved in 40.9 g of MEK to obtain additive solution b.

Antifoggant-1

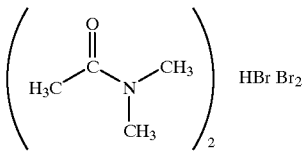

Antifoggant-2

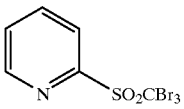

Preparation of Additive Solution c

Silver-saving agent H-94 o f 5.0 g was dissolved in 45.0 g of MEK to obtain additive solution c.

H-94

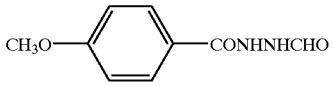

Preparation of Light Sensitive Layer Coating Solution A

Under an inert gas atmosphere (97% of nitrogen gas), light sensitive emulsion dispersing solution 1 of 50 g and 15.11 g MEK were maintained at 21° C. with stirring. Then, 1000 μl of chemical sensitizer S-5 (0.5% methanol solution) was added thereto and after 2 min., 390 μl of antifoggant 1 (10% methanol solution) was added and stirred for 1 hr. Further, 494 μl of calcium bromide (10% methanol solution) was added and after stirring for 30 min., gold sensitizer Au-5 of 1/20 equimolar amount to the above-described chemical sensitizer was added and stirred for 20 min. Subsequently, after adding 167 ml of the stabilizer solution and stirring for 10 min., 1.32 g of infrared sensitizing dye solution A was added and stirred for 1 hr. Thereafter, the temperature was lowered to 13° C. and stirring continued for 30 min. Then, 13.31 g of polyvinyl butyral (Butvar B-79) was added, stirred for 30 min.; 1.084 g of tetrachlorophthalic acid (9.4% MEK solution) was added and stirred fir 15 min., while the temperature was maintained at 13° C. Further, 12.43 g of additive solution a, 1.6 ml of 10% MEK solution of Desmodur N3300 and 4.27 g of additive solution c were successively added with stirring to obtain a light sensitive layer coating solution A.

S-5

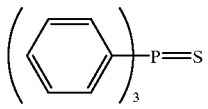

Au-5

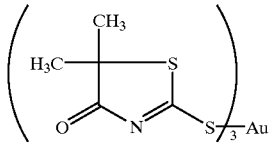

Preparation of Light Sensitive Layer Coating Solution A

Under an inert gas atmosphere (97% of nitrogen gas), light sensitive emulsion dispersing solution 1 of 50 g and 15.11 g MEK were maintained at 21° C. with stirring. Then, 1000 μl of chemical sensitizer S-5 (0.5% methanol solution) was added thereto and after 2 min., 390 μl of antifoggant 1 (10% methanol solution) was added and stirred for 1 hr. Further, 494 μl of calcium bromide (10% methanol solution) was added and after stirring for 30 min., gold sensitizer Au-5 of 1/20 equimolar amount to the above-described chemical sensitizer was added and stirred for 20 min. Subsequently, after adding 167 ml of the stabilizer solution and stirring for 10 min., 1.32 g of infrared sensitizing dye solution A was added and stirred for 1 hr. Thereafter, the temperature was lowered to 13° C. and stirring continued for 30 min. Then, 13.31 g of polyvinyl butyral (Butvar B-79) was added, stirred for 30 min.; 1.084 g of tetrachlorophthalic acid (9.4% MEK solution) was added and stirred fir 15 min., while the temperature was maintained at 13° C. Further, 12.43 g of additive solution a, 1.6 ml of 10% MEK solution of Desmodur N3300, 4.27 g of additive solution b and 10.0 g of additive solution were successively added with stirring to obtain a light sensitive layer coating solution B.

Preparation of Matting Agent Dispersion

In 42.5 g of MEK was dissolved 7.5 g of cellulose acetate butylate (CAB171-15, available from Eastman Chemical Corp.) and further therein, 5 g of calcium carbonate (Super-Pflex 200, available from Speciality Minerals Corp.) and stirred with dissolver type homogenizer at a speed of 8000 rpm for 30 min. to obtain a matting agent dispersion.

Preparation of Protective Layer Coating Solution

To 865 g of methyl ethyl ketone were added with stirring 96 g of cellulose acetate-butylate (CAB171-15, available from Eastman Chemical Co.) and 4.5 g of polymethyl methacrylate (Paraloid A-21, available from Rohm & Haas Corp.). Further thereto were added and dissolved 1.5 g of vinylsulfon compound HD-1, 1.0 g of benzotriazole and 1.0 g of fluorinated surfactant (Surflon KH40, available from ASAHI Glass Co. Ltd.). Then 30 g of the foregoing matting agent dispersion was added with stirring to obtain to obtain a coating composition for the surface protective layer.

HD-1 $(CH_2{=}CHSO_2CH_2)_2CHOH$

Preparation of Samples 31 through 41

The light sensitive layer coating solutions A and B, and protective layer coating solution were simultaneously coated by means of an extruder to prepared photothermographic material samples. Samples 31 through 41 were prepared by varying the amounts of the compounds of formulas (1), (2) and (3), as shown in Table 3. Each of the samples was so coated that the silver coverage of the light sensitive layers A and B were 0.7 and 0.3 g/m$^2$, respectively, and the dry thickness of the protective layer was 5 $\mu$m and drying was conducted at a drying temperature of 50° C. and a dew point of 10° C. for a period of 10 min.

The thus prepared sample 31 to 41 were each processed and evaluated in the same manner as in Example 1. Results thereof are shown in Table 3.

What is claimed is:

1. A photothermographic material comprising on a support an organic silver salt, a photosensitive silver halide, a reducing agent, a binder and a compound represented by the following formula (1):

$$R_1{-}SO_2{-}O{-}L_1{-}COOM_1 \qquad \text{formula (1)}$$

wherein $R_1$ represents a hydroxy group, a mercapto group, a halogen atom, a cyano group, a sulfo group, a nitro group, a sulfino group, a hydrazino group, a heterocyclic group, or a hydrocarbon group; $M_1$ represents a cation; and $L_1$ represents a bivalent group.

2. The photothermographic material of claim 1, wherein in formula (1), the hydrazino group is an alkyl hydrazino group or an aryl hydrazino group; and the hydrocarbon group is a straight, branched or cyclic alkyl, alkenyl or alkynyl group, or an aryl group; and the heterocyclic group is an imidazolyl group, a pyridyl group, a furyl group, a piperazino group or a morpholino group.

3. The photothermographic material of claim 1, wherein in formula (1), $R_1$ is an alkyl group, an aryl group or an aralkyl group.

4. The photothermographic material of claim 1, wherein $L_1$ is an alkylene group or an arylene group.

5. The photothermographic material of claim 4, wherein $L_1$ is a phenylene group.

6. The photothermographic material of claim 5, wherein $L_1$ is an o-phenylene group.

7. The photothermographic material of claim 3, wherein the alkyl group has 1 to 20 carbon atoms, the aryl group having 6 to 30 carbon atom and the aralkyl group having 7 to 30 carbon atoms.

8. The photothermographic material of claim 7, wherein $L_1$ is a phenylene group.

9. The photothermographic material of claim 1, containing the compound of formula (1) in an amount of not less than 0.005 mol/mol Ag.

TABLE 3

| Sample | Compound | Compound | Compound | | | Storage Stability | | |
|---|---|---|---|---|---|---|---|---|
| No. | (mol/Ag mol) | (mol/Ag mol) | (mol/Ag mol) | S | Fog | ΔS | ΔFog | Remark |
| 31 | — | — | (3)-24 (0.1) | 100 | 0.13 | 30 | 0.15 | Comp. |
| 32 | — | (2)-30 (0.1) | — | 110 | 0.22 | 40 | 0.24 | Comp. |
| 33 | (1)-27 (0.1) | — | — | 95 | 0.03 | −5 | −0.01 | Inv. |
| 34 | (1)-27 (0.05) | (2)-30 (0.05) | — | 120 | 0.07 | 7 | 0.02 | Inv. |
| 35 | (1)-27 (0.05) | — | (3)-24 (0.05) | 105 | 0.04 | 5 | 0.02 | Inv. |
| 36 | (1)-27 (0.08) | (2)-30 (0.02) | — | 100 | 0.03 | 4 | 0.01 | Inv. |
| 37 | (1)-27 (0.08) | — | (3)-24 (0.02) | 110 | 0.02 | 2 | 0.01 | Inv. |
| 38 | (1)-27 (0.1) | (2)-30 (0.02) | — | 115 | 0.02 | 2 | 0.01 | Inv. |
| 39 | (1)-27 (0.1) | — | (3)-24 (0.02) | 113 | 0.02 | 1 | 0.01 | Inv. |
| 40 | (1)-27 (0.125) | (2)-30 (0.025) | — | 103 | 0.01 | 0 | 0 | Inv. |
| 41 | (1)-27 (0.125) | — | (3)-24 (0.025) | 107 | 0.01 | 0 | 0 | Inv. |

10. The photothermographic material of claim 1, comprising a compound represented by formula (2) or (3):

$$R_2—COOM_2 \quad \text{formula (2)}$$

wherein $R_2$ represents a hydroxy group, a mercapto group, a halogen atom, a cyano group, a sulfo group, a nitro group, a sulfino group, a hydrazino group, a heterocyclic group, or a hydrocarbon group; $M_2$ represents a cation;

$$R_3—CO—L_2—COOM_3 \quad \text{formula (3)}$$

wherein $R_3$ represents a hydroxy group, a mercapto group, a halogen atom, a cyano group, a sulfo group, a nitro group, a sulfino group, a hydrazino group, a heterocyclic group, or a hydrocarbon group; $M_3$ represents a cation and $L_2$ represents a bivalent group.

11. The photothermographic material of claim 10, wherein in formula (2) or (3), $R_2$ or $R_3$ is an alkyl group, an aryl group or an aralkyl group.

12. The photothermographic material of claim 11, wherein the alkyl group has 1 to 20 carbon atoms, the aryl group having 6 to 30 carbon atom and the aralkyl group having 7 to 30 carbon atoms.

13. The photothermographic material of claim 10, wherein the compound of formula (2) is contained in an amount of 5 to 100% by weight, based on the compound of formula (1), or the compound of formula (3) being contained in an amount of 5 to 300% by weight, based on the compound of formula (1).

14. The photothermographic material of claim 10, comprising the compound of formula (1) and the compound of formula (2).

15. The photothermographic material of claim 14, wherein the compound of formula (2) is contained in an amount of 5 to 100% by weight, based on the compound of formula (1).

16. The photothermographic material of claim 15, wherein in formula (2) or (3), $R_2$ or $R_3$ is an alkyl group having 1 to 30 carbon atoms, an aryl group having 6 to 30 carbon atoms or an aralkyl group having 7 to 30 carbon atoms.

17. The photothermographic material of claim 10, wherein in formula (3), $L_2$ is an alkylene group or an arylene group.

18. The photothermographic material of claim 10, wherein in formula (3), $L_2$ is a phenylene group.

19. The photothermographic material of claim 10, wherein in formula (3), $L_2$ is an o-phenylene group.

20. The photothermographic material of claim 10, comprising the compound of formula (1) and the compound of formula (3).

21. The photothermographic material of claim 10, comprising the compound of formula (1), the compound of formula (2) and the compound of formula (3).

22. The photothermographic material of claim 21, wherein the compound of formula (2) is contained in an amount of 5 to 100% by weight, based on the compound of formula (1), the compound of formula (3) being contained in an amount of 5 to 300% by weight, based on the compound of formula (1).

* * * * *